United States Patent [19]

Williams

[11] 4,383,937

[45] May 17, 1983

[54] AQUEOUS FUNCTIONAL FLUID COMPOSITIONS

[75] Inventor: Mark A. Williams, Cincinnati, Ohio

[73] Assignee: Cincinnati Milacron Inc., Cincinnati, Ohio

[21] Appl. No.: 303,770

[22] Filed: Sep. 21, 1981

[51] Int. Cl.[3] ..... C23F 11/12; C23F 11/14

[52] U.S. Cl. ..... 252/389 R; 106/14.13; 106/14.15; 252/33.6; 252/34.7; 252/392; 252/396; 422/16; 422/17

[58] Field of Search ..... 252/389 R, 392, 396, 252/33.6, 34.7; 106/14.13, 14.15; 422/16, 17

[56] References Cited

U.S. PATENT DOCUMENTS

| | | | |
|---|---|---|---|
| 2,689,828 | 9/1954 | Smith et al. | 252/34 |
| 2,959,547 | 11/1960 | Brillhart | 252/33.6 |
| 3,981,780 | 9/1976 | Scherrer et al. | 252/392 |
| 4,053,426 | 10/1977 | Davis et al. | 252/34 |
| 4,069,023 | 1/1978 | Brois et al. | 252/392 |
| 4,116,643 | 9/1978 | Ryer et al. | 252/392 |
| 4,157,243 | 6/1979 | Ryer et al. | 252/392 |
| 4,250,042 | 12/1981 | Higgins et al. | 252/392 |
| 4,252,743 | 2/1981 | Quinlan | 422/16 |
| 4,273,664 | 6/1981 | Brandolese | 252/392 |

FOREIGN PATENT DOCUMENTS 1583678 of 0000 United Kingdom .

*Primary Examiner*—Irwin Gluck
*Attorney, Agent, or Firm*—Donald Dunn

[57] ABSTRACT

Corrosion inhibiting aqueous functional fluid compositions are provided which comprise (a) water (b) a water soluble or dispersible, surface active, corrosion inhibiting alkali metal, ammonium or organic amine salt of a water insoluble $C_4$ to $C_9$ aliphatic monohydric secondary alcohol half ester of a hydrocarbon cyclic dicarboxylic acid or anhydride, said half ester having a molecular weight of from 240 to 297, (e.g. monoethanolamine salt of the 2-octanol half ester of phthalic acid) and optionally (c) a substance selected from the group consisting of an anionic surfactant, a nonionic surfactant, a cationic surfactant, an amphoteric surfactant and a lubricant or mixture thereof, the fluid having a pH in the range of 8 to 12. Such aqueous fluids are useful as metal working fluids.

23 Claims, No Drawings

AQUEOUS FUNCTIONAL FLUID COMPOSITIONS

FIELD OF INVENTION

This invention relates to aqueous functional fluid compositions such as, for example, aqueous metal working fluids and water based hydraulic fluids. More particularly this invention relates to corrosion inhibiting aqueous functional fluid compositions containing a surface active, corrosion inhibiting salt of an aliphatic monohydric secondary alcohol half ester of a carbocyclic dicarboxylic acid or anhydride.

BACKGROUND

Aqueous functional fluids have, especially in recent years, gained substantial commercial important because of their well known economic, safety and environmental advantages over non-aqueous functional fluids, as well as their improved performance characteristics. These aqueous functional fluids have found significant usage as metal working fluids in a large variety of metal working processes (e.g. forming, grinding, drilling, broaching, milling, drawing and turning) and as hydraulic fluids.

Although aqueous functional fluids have been found to possess a number of advantages, they continue to show significant problems which limit their usefulness and usage. Chief among the problems presented by the use of aqueous functional fluids is the problem of corrosion control and prevention. This problem of corrosion control and prevention is particularly accentuated where the aqueous functional fluid contacts ferrous metals, although various degrees of corrosion may also occur where the aqueous functional fluid contacts nonferrous metals (e.g. aluminum and copper). In metal working processes such corrosion leads to excessive wear of machine tool components and poorly finished products, while in hydraulic systems such corrosion leads to the destruction of pump components, valves and lines. Thus, corrosion inhibition becomes an important factor in aqueous functional fluids and such fluids having a high degree of corrosion inhibiting activity without sacrifice of the fluids' primary functions are therefore highly desirable. Strong corrosion inhibiting activity in aqueous functional fluids is continuously sought in the art.

Instability during storage and use is another problem often possessed by aqueous functional fluids. Such instability may lead to separation of the components, deterioration of the components and loss of the principle functions of the aqueous functional fluid. Where separation of the components of the fluid occurs, uneven concentrations of the components results and erractic, poor performance of the aqueous functional fluid is obtained. The art therefore continuously seeks to overcome such stability problems and provide (1) improved aqueous functional fluids having a high degree of stability and (2) materials which impart a high degree of stability to such fluids.

It is an object of this invention to provide an aqueous functional fluid having a high degree of corrosion inhibiting activity.

Another object of this invention is to provide an aqueous functional fluid having a component which imparts both stability and a corrosion inhibiting activity to the fluid.

SUMMARY OF THE INVENTION

It has now been discovered that the foregoing objects and others, as will be apparent from the following description and appended claims, can be achieved by a corrosion inhibiting aqueous functional fluid comprising (a) water, (b) a water soluble or dispersible, surface active, corrosion inhibiting alkali metal, ammonium or organic amine salt of a water insoluble $C_4$ to $C_{10}$ aliphatic monohydric secondary alcohol half ester of a hydrocarbon carbocyclic dicarboxylic acid or anhydride having 6 to 9 carbon atoms and a $C_4$ to $C_6$ carbocyclic ring and selected from the group consisting of cycloaliphatic, alkyl substituted cycloaliphatic, aromatic or alkyl substituted aromatic dicarboxylic acid or anhydride, and half ester having a molecular weight in the range of from 240 to 297 and optionally (c) a substance selected from the group consisting of a surfactant and a water soluble or dispersible lubricant or mixtures thereof, said fluid having a pH in the range of 8–12. Further, it has been discovered that the above objects and others, as will become apparent from the following description and claims can be achieved by a method for preparing a corrosion inhibiting aqueous functional fluid composition comprising the steps of (1) mixing together (a) water, (b) a water soluble or dispersible, surface active, corrosion inhibiting alkali metal, ammonium or organic amine salt of a water insoluble $C_4$ to $C_{10}$ aliphatic monohydric secondary alcohol half ester of a hydrocarbon carbocyclic dicarboxylic acid or anhydride having 6 to 9 carbon atoms and a $C_4$ to $C_6$ carbocyclic ring and selected from the group consisting of cycloaliphatic, alkyl substituted cycloaliphatic, aromatic or alkyl substituted aromatic dicarboxylic acid or anhydride, said half ester having a molecular weight of from 240 to 297 and optionally (c) a substance selected from the group consisting of a surfactant, and a water soluble or dispersible lubricant or mixtures thereof and (2) adjusting the pH of the fluid to within the range of from 8 to 12.

The corrosion inhibiting aqueous functional fluid compositions according to this invention are useful as hydraulic fluids and as metal working fluids in metal working processes, such as, for example, drawing, spinning, stamping, rolling, forming, drilling, tapping, milling, turning, broaching and grinding. Advantageously, the corrosion inhibiting aqueous functional fluid compositions according to this invention exhibit (1) high stability (i.e. resistance to separation of the components of the composition) during storage and use, (2) activity leading to reduction or prevention of corrosion of the workpiece, finished part and machine components during the metal working process and (3) activity leading to reduction or prevention of corrosion of metallic components of a hydrualic system. High stability during storage and use is important to obtaining the maximum utilization and useful life of an aqueous functional fluid. Separation of the components of the aqueous functional fluid produces a heterogeneous system (i.e. a fluid having uneven distribution of the component or components in the fluid). Such heterogeniety contributes to or causes significantly reduced performance and in some cases causes essentially complete loss of performance of the fluid for its intended purpose. Thus, where the fluid is used as a hydraulic fluid the separation of the components can result in erratic or complete loss of performance as a hydraulic fluid. Where the fluid is used as a metal working fluid such separation of the components of the fluid can result in increased friction, increased working forces, poor surface finish for the product of the metal working process, out of specification parts, increased scrap, reduced tool life and corrosion problems.

It has been surprisingly found that the water soluble or dispersible alkali metal, ammonium or organic amine salt of the water insoluble half ester, as disclosed herein and set forth in the appended claims, exhibits combined coupling (i.e. surface active) and corrosion inhibiting activities in the aqueous functional fluid compositions of this invention. This dual activity was unexpected and confers advantages to the aqueous functional fluid compositions of this invention. One such advantage is that the dual coupling (i.e. surface active) and corrosion inhibiting activities of the water soluble or dispersible alkali metal, ammonium or organic amine salt of the water insoluble half ester (as disclosed herein and set forth in the appended claims) reduces the number of components in the aqueous functional fluid by reducing the need for a separate corrosion inhibiting component in the fluid. Another advantage is that the dual surface active and corrosion inhibiting activities of the water soluble or dispersible alkali metal, ammonium or organic amine salt of the water insoluble half ester, as disclosed herein and set forth in the claims, of the aqueous functional fluid composition of this invention may reduce the amounts of other surfactants and/or other corrosion inhibiting agents in the aqueous functional fluid. A still further advantage is that in view of the dual surface active and corrosion inhibiting activities of the water soluble or dispersible alkali metal, ammonium or organic amine salt of the water insoluble half ester, as taught herein and set forth in the appended claims, the aqueous functional fluid composition of this invention can have high stability (i.e. resistance to deterioration and separation) during storage and use and long useful life.

DESCRIPTION OF THE INVENTION

There is now provided in accordance with this invention a corrosion inhibiting aqueous functional fluid composition comprising (a) water, (b) a water soluble or dispersible, surface active, corrosion inhibiting alkali metal, ammonium or organic amine salt of a water insoluble $C_4$ to $C_{10}$ aliphatic monohydric secondary alcohol half ester of a hydrocarbon carbocyclic dicarboxylic acid or anhydride having 6 to 9 carbon atoms and a $C_4$ to $C_6$ carbocyclic ring and selected from the group consisting of cycloaliphatic, alkyl substituted cycloaliphatic, aromatic and alkyl substituted aromatic dicarboxylic acid and anhydride, said half ester having a molecular weight in the range of 240 to 297 and optionally (c) a substance selected from the group consisting of a surfactant, and a water soluble or dispersible organic lubricant or mixtures thereof, said fluid having a pH in the range of 8–12. Additionally, there is provided in accordance with this invention a method for preparing a corrosion inhibiting aqueous functional fluid composition comprising the steps of (1) mixing together (a) water, (b) a water soluble or dispersible, surface active, corrosion inhibiting alkali metal, ammonium or organic amine salt of a water insoluble $C_4$ to $C_{10}$ aliphatic monohydric secondary alcohol half ester of a hydrocarbon carbocyclic dicarboxylic acid or anhydride having 6 to 9 carbon atoms and a $C_4$ to $C_6$ carbocyclic ring and selected from the group consisting of cycloaliphatic, alkyl substituted cycloaliphatic, aromatic or alkyl substituted aromatic dicarboxylic acid or anhydride, said half ester having a molecular weight in the range of from 240 to 297 and optionally, (c) a substance selected from the group consisting of a surfactant and a water soluble or dispersible organic lubricant or mixtures thereof and (2) adjusting the pH of the fluid to within the range of from 8 to 12.

In accordance with this invention there is further provided a corrosion inhibiting aqueous functional fluid composition comprising (a) water, (b) a water soluble or dispersible surface active, corrosion inhibiting alkali metal, ammonium or organic amine salt of a water insoluble half ester having the formula

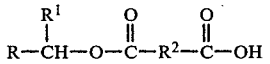

(I)

wherein

R and $R^1$ are the same or different and are selected from the group consisting of branched or straight chain alkyl group having 1 to 8 carbon atoms or branched or straight chain alkenyl or alkynyl group having 2 to 8 carbon atoms such that the sum of the carbon atom content of R and $R^1$ is from 3 to 9 and $R^2$ is a divalent hydrocarbon carbocylic group having from 4 to 7 carbon atoms and a $C_4$ to $C_6$ carbocyclic ring selected from the group consisting of divalent cycloaliphatic, alkyl substituted cycloaliphatic, aromatic and alkyl substituted aromatic radicals, said half ester having a molecular weight in the range of from 240 to 297 and optionally, (c) a substance selected from the group consisting of a surfactant and a water soluble or dispersible organic lubricant or mixtures thereof, said fluid having a pH in the range of 8 to 12. A method is provided, according to this invention, for preparing a corrosion inhibiting aqueous functional fluid composition comprising the steps of (1) mixing together (a) water, (b) a water soluble or dispersible, surface active, corrosion inhibiting, alkali metal, ammonium or organic amine salt of a water insoluble half ester having the formula (I), said half ester having a molecular weight in the range of from 240 to 297 and optionally, (c) a substance selected from the group consisting of a surfactant and a water soluble or dispersible organic lubricant or mixtures thereof and (2) adjusting the pH of the fluid to within the range of 8 to 12.

In accordance with one embodiment of this invention there is provided a corrosion inhibiting aqueous functional fluid composition comprising (a) water, (b) a water soluble or dispersible, surface active, corrosion inhibiting alkali metal, ammonium or organic amine salt of a water insoluble $C_4$ to $C_{10}$ aliphatic monohydric secondary alcohol half ester of a hydrocarbon carbocyclic dicarboxylic acid or anhydride having 6 to 9 carbon atoms and a $C_4$ to $C_6$ carbocyclic ring and selected from the group consisting of cycloaliphatic, alkyl substituted cycloaliphatic, aromatic and alkyl substituted aromatic dicarboxylic acid and anhydride, said half ester having a molecular weight in the range of 240 to 297 and (c) a substance selected from the group consisting of a surfactant and a water soluble or dispersible organic lubricant or mixtures thereof, said fluid having a pH in the range of 8–12.

In another embodiment there is provided in accordance with this invention a corrosion inhibiting aqueous functional fluid composition comprising (a) water and (b) a water soluble or dispersible, surface active, corrosion inhibiting alkali metal, ammonium or organic amine salt of a water insoluble $C_4$ to $C_{10}$ aliphatic monohydric secondary alcohol half ester of a hydrocarbon carbocyclic dicarboxylic acid or anhydride having 6 to 9 carbon atoms and a $C_4$ to $C_6$ carbocyclic ring and selected from the group consisting of cycloaliphatic, alkyl substituted cycloaliphatic, aromatic and alkyl substituted aromatic dicarboxylic acid and anhydride, and half ester having a molecular weight in the range of 240 to 297, said fluid having a pH in the range of 8–12. As an even further embodiment, there is provided in accordance with this invention a method for preparing a corrosion inhibiting aqueous functional fluid composition comprising the steps of (1) mixing together (a) water and (b) a water soluble or dispersible, surface active, corrosion inhibiting alkali metal, ammonium or organic amine salt of a water insoluble $C_4$ to $C_{10}$ aliphatic monohydric secondary alcohol half ester of a hydrocarbon carbocyclic dicarboxylic acid or anhydride having 6 to 9 carbon atoms and a $C_4$ to $C_6$ carbocyclic ring and selected from the group consisiting of cycloaliphatic, alkyl substituted cycloaliphatic, aromatic or alkyl substituted aromatic dicarboxylic acid or anhydride, said half ester having a molecular weight in the range of from 240 to 297 and (2) adjusting the pH of the fluid to within the range of from 8 to 12.

Additionally, as a further embodiment, there is provided in accordance with this invention a method for preparing a corrosion inhibiting aqueous functional fluid composition comprising the steps of (1) mixing together (a) water, (b) a water soluble or dispersible, surface active, corrosion inhibiting alkali metal, ammonium or organic amine salt of a water insoluble $C_4$ to $C_{10}$ aliphatic monohydric secondary alcohol half ester of a hydrocarbon carbocyclic dicarboxylic acid or anhydride having 6 to 9 carbon atoms and a $C_4$ to $C_6$ carbocyclic ring and selected from the group consisting of cycloaliphatic, alkyl substituted cycloaliphatic, aromatic or alkyl substituted aromatic dicarboxylic acid or anhydride, said half ester having a molecular weight in the range of from 240 to 297 and, (c) a substance selected from the group consisting of a surfactant and a water soluble or dispersible organic lubricant or mixtures thereof and (2) adjusting the pH of the fluid to within the range of from 8 to 12.

In accordance with a further embodiment of this invention there is provided a corrosion inhibiting aqueous functional fluid composition comprising (a) water, (b) a water soluble or dispersible surface active, corrosion inhibiting alkali metal, ammonium or organic amine salt of a water insoluble half ester having the formula

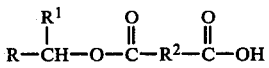

(I)

wherein

R and $R^1$ are the same or different and are selected from the group consisting of branched or straight chain alkyl group having 1 to 8 carbon atoms or branched or straight chain alkenyl or alkynyl group having 2 to 8 carbon atoms such that the sum of the carbon atom content of R and $R^1$ is from 3 to 9 and $R^2$ is a divalent hydrocarbon carbocyclic group having from 4 to 7 carbon atoms and a $C_4$ to $C_6$ carbocyclic ring selected from the group consisting of divalent cycloaliphatic, alkyl substituted cycloaliphatic, aromatic and alkyl substituted aromatic radicals, said half ester having a molecular weight in the range of from 240 to 297 and (c) a substance selected from the group consisting of a surfactant and a water soluble or dispersible organic lubricant or mixtures thereof, said fluid having a pH in the range of 8 to 12. A method is provided, according to an embodiment of this invention, for preparing a corrosion inhibiting aqueous functional fluid composition comprising the steps of (1) mixing together (a) water, (b) a water soluble or dispersible, surface active, corrosion inhibiting, alkali metal, ammonium or organic amine salt of a water insoluble half ester having the formula (I), said half ester having a molecular weight in the range of from 240 to 297 and (c) a substance selected from the group consisting of a surfactant and a water soluble or dispersible organic lubricant or mixtures thereof, and (2) adjusting the pH of the fluid to within the range of 8 to 12.

In a still further embodiment of this invention there is provided a corrosion inhibiting aqueous functional fluid composition comprising (a) water and (b) a water soluble or dispersible surface active, corrosion inhibiting alkali metal, ammonium or organic amine salt of a water insoluble half ester having the formula

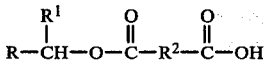

(I)

wherein

R and $R^1$ are the same or different and are selected from the group consisting of branched or straight chain alkyl group having 1 to 8 carbon atoms such that the sum of the carbon atom content of R and $R^1$ is from 3 to 9 and $R^2$ is a divalent hydrocarbon carbocyclic group having from 4 to 7 carbon atoms and a $C_4$ to $C_6$ carbocyclic ring selected from the group consisting of divalent cycloaliphatic, alkyl substituted cycloaliphatic, aromatic and alkyl substituted aromatic radicals, said half ester having a molecular weight in the range of from 240 to 297, said fluid having a pH in the range of 8 to 12. There may be practiced a method according to this invention, for preparing a corrosion inhibiting aqueous functional fluid composition, comprising the steps of (1) mixing together (a) water and (b) a water soluble or dispersible, surface active, corrosion inhibiting, alkali metal, ammonium or organic amine salt of a water insoluble half ester having the formula (I), said half ester having a molecular weight in the range of from 240 to 297 and (2) adjusting the pH of the fluid to within the range of 8 to 12.

As further embodiments of this invention there include, but not limited to, the afore described corrosion inhibiting aqueous functional fluid composition and the method of preparing a corrosion inhibiting aqueous functional fluid composition according to this invention wherein (1) the water soluble or dispersible, surface active, corrosion inhibiting, organic amine salt is an organic amine salt of the water insoluble $C_4$ to $C_{10}$ aliphatic monohydric secondary alcohol half ester of a hydrocarbon cycloaliphatic dicarboxylic acid or anhydride having from 6 to 9 carbon atoms and a $C_4$ to $C_6$ carbocyclic ring, said half ester having a molecular weight in the range of 240 to 297, (2) the water soluble or dispersible, surface active, corrosion inhibiting organic amine salt is an organic amine salt of the water insoluble $C_4$ to $C_{10}$ aliphatic monohydric secondary alcohol half ester of a hydrocarbon alkyl substituted cycloaliphatic dicarboxylic acid or anhydride having 7 to 9 carbon atoms and a $C_4$ to $C_6$ carbocyclic ring, said half ester having a molecular weight in the range of from 240 to 297, (3) the water soluble or dispersible, surface active, corrosion inhibiting organic amine salt is an organic amine salt of the water insoluble $C_4$ to $C_{10}$ aliphatic monohydric secondary alcohol half ester of a hydrocarbon aromatic dicarboxylic acid or anhydride having 8 carbon atoms and a $C_6$ carbocyclic ring, said half ester having a molecular weight in the range of from 240 to 297, (4) the water soluble or dispersible surface active corrosion inhibiting, organic amine salt is an organic amine salt of the water insoluble $C_4$ to $C_{10}$ aliphatic monohydric secondary alcohol half ester of a hydrocarbon alkyl substituted aromatic dicarboxylic acid or anhydride having 9 carbon atoms and a $C_6$ carbocyclic ring, said half ester having a molecular weight in the range of from 240 to 297, (5) the water soluble or dispersible, surface active, corrosion inhibiting organic amine salt is an organic amine salt of the water insoluble half ester according to formula (I) wherein $R^2$ is the cycloaliphatic divalent hydrocarbon radical having 4 to 6 carbon atoms and a $C_4$ to $C_6$ carbocyclic ring and said half ester has a molecular weight in the range of from 240 to 297, (6) the water soluble or dispersible, surface active, corrosion inhibiting organic amine salt is an organic amine salt of the water insoluble half ester according to formula (I) wherein $R^2$ is the alkyl substituted cycloaliphatic divalent hydrocarbon radical having 5 to 7 carbon atoms and a $C_4$ to $C_6$ carbocyclic ring and said half ester has a molecular weight in the range of from 240 to 297, (7) the water soluble or dispersible, surface active, corrosion inhibiting organic amine salt is an organic amine salt of the water insoluble half ester according to formula (I) wherein $R^2$ is the aromatic divalent hydrocarbon radical having 6 carbon atoms and a $C_6$ carbocyclic ring, said half ester having a molecular weight in the range of from 240 to 297, (8) the water soluble or dispersible, surface active, corrosion inhibiting organic amine salt is the organic amine salt of the water insoluble half ester according to formula (I) wherein $R^2$ is an alkyl substituted aromatic divalent hydrocarbon radical having 7 carbon atoms and a $C_6$ carbocyclic ring, said half ester having a molecular weight in the range of from 240 to 297, (9) the water soluble or dispersible, surface active, corrosion inhibiting organic amine salt is the organic amine salt of the water insoluble half ester according to formula (I) wherein R and $R^1$ are the same or different alkyl group having 1 to 8 carbon atoms such that the sum of the carbon atom content of R and $R^1$ is from 3 to 9 and said half ester has a molecular weight in the range of from 240 to 297 or (10) the water soluble or dispersible, surface active, corrosion inhibiting organic amine salt is the organic amine salt of the water insoluble half ester according to formula (I) wherein R is an alkenyl group having 2 to 8 carbon atoms, $R^1$ is an alkyl group having 1 to 8 carbon atoms, such that the sum of the carbon atom content of R and $R^1$ is from 3 to 9 and said half ester has a molecular weight in the range of from 240 to 297.

In accordance with this invention and as used in this specification and claims the term organic amine is meant to identify and include compounds having at least one amine nitrogen atom. The organic amine used in the practice of this invention is an organic amine forming a water soluble or dispersible salt of the water insoluble half ester described herein. The organic amines usable for making the water soluble or dispersible organic amine salt of the water insoluble half ester according to formula (I) are preferably aliphatic amines which include, for example, alkyl primary, secondary or tertiary monoamines, alkenyl primary, secondary or tertiary monoamines, alkylene diamines, polyalkylene polyamines, polyoxyalkylene diamines, alkanol amines and alkyl alkanol amines. Water soluble heterocyclic amines having oxygen and/or nitrogen heteroatoms in the ring (e.g. morpholine, pyridine, pyrimidine and pyrrole) are useful for making the water soluble or dispersible organic amine salt of the water insoluble half ester according to formula (I).

Where the organic amine is an alkyl primary, secondary or tertiary amine preferably it is a water soluble alkyl primary, secondary or tertiary amine, for example, ethyl amine, diethyl amine, triethyl amine and isobutyl amine. As the organic amine there may be used an alkylene diamine, preferably a water soluble alkylene diamine having 2 to 6 carbon atoms in the alkylene group and nitrogen atoms which may be unsubstituted or may have a total of from 1 to 4 $C_1$ to $C_4$ alkyl or $C_1$ to $C_4$ hydroxyalkyl substituents individually or in combination, including, for example, ethylene diamine, 1,3-propylene diamine, 1,6-hexamethylene diamine, N,N-dimethyl amino propyl amine, hydroxyethyl ethylene diamine, N,N,N',N'-tetrakis(2-hydroxyethyl)ethylene diamine, N,N,N'N',-tetramethyl ethylene diamine and N-propyl-N'-hydroxybutyl-1,6-hexamethylene diamine.

When the organic amine is a polyalkylene polyamine it is preferably a water soluble polyalkylene polyamine having 3 to 6 nitrogen atoms and an alkylene group having 2 to 3 carbon atoms, for example, diethylene triamine, triethylene tetramine, tetraethylene pentamine, pentaethylene hexamine, dipropylene triamine and N,N-bis-(3-aminopropyl)methyl amine. There may be used as the organic amine a polyoxyalkylene homopolymer and copolymer diamine preferably a water soluble polyoxyalkylene homopolymer and copolymer diamine having an average molecular weight in the range of 130 to 2000, examples of which include but are not limited to polyoxyethylene diamine, polyoxypropylene diamine and block and random oxyethylene/oxypropylene copolymer diamines. Preferably the organic amine usable for making the organic amine salt of the half ester according to formula (I) in the practice of this invention is an alkanol amine, more preferably a water soluble alkanol amine examples of which include but are not limited to monoethanol amine, diethanol amine, triethanol amine, monoisopropanol amine, diisopropanol amine, triisopropanol amine, monopropanol amine, monobutanol amine, dibutanol amine, tributanol amine, N-methyl ethanol amine, N,N-diethyl ethanol amine, N,N-dimethyl ethanol amine, N,N-dibutyl-3-hydroxypropyl amine, N-isobutyl-4-hydroxybutyl amine, N-ethyl ethanol amine, N-propyl-bis-4-hydroxybutyl amine, hydroxy ethyl ethylene diamine, N,N,N',N'-tetrakis(2-hydroxyethyl)ethylene diamine and N-propyl-N'-hydroxybutyl-1,6-hexamethylene diamine. Preferably the alkanol amines used in the practice of this invention are water soluble alkanol amines. The alkanol group may be a straight or branched chain group, preferably containing 2 to 6 carbon atoms.

Where the alkanol amine contains an alkyl group bonded to the amine nitrogen it is preferred that the alkyl group be a hydrocarbon group containing from 1 to 4 carbon atoms. The essential feature of the alkanol amine is that it forms a water soluble or dispersible amine salt of the water insoluble half ester described herein.

The alkali metal salt of the half ester according to formula (I) in the practice of this invention is a group I metal, preferably sodium or potassium, salt of the half ester according to formula (I).

There is employed in accordance with this invention a water soluble or dispersible, surface active, corrosion inhibiting alkali metal, ammonium or organic amine salt of a water insoluble $C_4$ to $C_{10}$ aliphatic monohydric secondary alcohol half ester of a hydrocarbon $C_6$ to $C_9$ carbocyclic dicarboxylic acid or anhydride having a $C_4$ to $C_6$ carbocyclic ring and selected from the group consisting of a cycloaliphatic, alkyl substituted cycloaliphatic, aromatic and alkyl substituted aromatic dicarboxylic acid and anhydride, said half ester having a molecular weight in the range of from 240 to 297. As used in this disclosure and claims the term dicarboxylic acid is meant to include both dicarboxylic acid and dicarboxylic acid halide since both the dicarboxylic acid and its corresponding acid halide are usable in the preparation of the half ester. Where the dicarboxylic acid halide is used to prepare the half ester it is preferred to neutralize the remaining acid halide group after the formation of the half ester, prior to forming the alkali metal, ammonium or organic amine salt. Examples of the cycloaliphatic, alkyl substituted cycloaliphatic, aromatic and alkyl substituted aromatic dicarboxylic acids and anhydrides usable in the practice of this invention include, but are not limited to, 1,2-cyclobutane dicarboxylic acid, 1,2-cyclobutane dicarboxylic anhydride, 1,1-cyclobutane dicarboxylic acid, 1,3-cyclobutane dicarboxylic acid, 1,2-cyclopentane dicarboxylic acid, 1,2-cyclopentane dicarboxylic anhydride, 1,3-cyclopentane dicarboxylic acid, 1,2-cyclohexane dicarboxylic acid, 1,2-cyclohexane dicarboxylic anhydride, 1,3-cyclohexane dicarboxylic acid, 1,4-cyclohexane dicarboxylic acid, 1-cyclohexene-1,2-dicarboxylic acid, 1-cyclohexene-1,2-dicarboxylic anhydride, 3-cyclohexene-1,2-dicarboxylic anhydride,4-cyclohexene-1,2-dicarboxylic anhydride, 1,4-cyclohexadiene-1,2-dicarboxylic acid, 2,6-cyclohexadiene-1,2-dicarboxylic acid, 2,4-cyclohexadiene-1,2-dicarboxylic acid, 4,4-dimethyl-1,3-cyclopentane dicarboxylic acid, 4-methyl-1,2-cyclohexane dicarboxylic anhydride, phthalic acid, phthalic anhydride, isophthalic acid, terephthalic acid and 5-methyl-1,3-benzene dicarboxylic acid. The corresponding acid halide (e.g. acid chloride or acid bromide) may be used in place of any of the aforementioned dicarboxylic acids in the practice of this invention. There may also be used in the practice of this invention the cis and trans isomers of the dicarboxylic acids and anhydrides.

As examples of the $C_4$ to $C_{10}$ aliphatic monohydric secondary alcohol usable for making the half ester in the practice of this invention there include, but not limited to, 2-butanol, 2-pentanol, 3-pentanol, 2-hexanol, 3-hexanol, 2-octanol, 2-decanol, 4-decanol, 2,6-dimethyl-4-heptanol, 2,2-dimethyl-3-pentanol, 5-methyl-2-hexanol, 5-methyl-3-hexanol, 1-hexen-3-ol, 1-octen-3-ol and 1-octyn-3-ol. The $C_4$ to $C_{10}$ aliphatic monohydric secondary alcohol usable for making the half ester in the practice of this invention may be saturated or unsaturated. Preferably the $C_4$ to $C_{10}$ aliphatic monohydric secondary alcohol is saturated. Mixtures of $C_4$ to $C_{10}$ aliphatic monohydric secondary alcohols may be used.

Among the half esters according to formula (I) usable in the practice of this invention there, for example, include, but not limited to, water insoluble half esters according to formula (I) wherein R,$R^1$ and $R^2$ are as indicated in the following table (Table I).

TABLE I

| R | $R^1$ | $R^2$ |
|---|---|---|
| $CH_3CH_2$— | $CH_3CH_2CH_2$— | 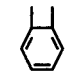 |
| $CH_3CH_2$— | $CH_3CH_2CH_2CH_2$— | 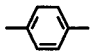 |
| $CH_3(CH_2)_4CH_2$— | $CH_3CH_2$— | 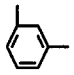 |
| $CH_3(CH_2)_7$ | $CH_3$— | 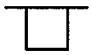 |
| $CH_3(CH_2)_5CH_2$— | $CH_3$— | 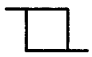 |
| $CH_3CH_2CH_2$— | $CH_3CH_2$— | 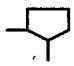 |
| $CH_3(CH_2)_4CH_2$— | $CH_3$— | 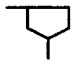 |
| $CH_3(CH_2)_3CH_2$— | $CH_3$— | 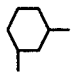 |
| $CH_3(CH_2)_3CH_2$— | $CH_3(CH_2)_2$ | 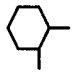 |
| $CH_3CH(CH_3)CH_2$— | $CH_3CH(CH_3)CH_2$— | 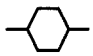 |
| $CH_3C(CH_3)_2$— | $CH_3CH_2$— | 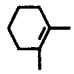 |
| $CH_3$— | $CH_3CH(CH_3)CH_2CH_2$— | 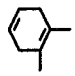 |
| $CH_3CH_2$— | $CH_3CH(CH_3)CH_2$— | 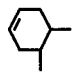 |
| $CH_2{=}CH$— | $CH_3CH_2CH_2CH_2$— | 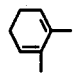 |
| $CH_2{=}CH$— | $CH_3(CH_2)_3CH_2$— | 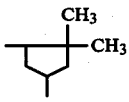 |

TABLE I-continued

| R | $R^1$ | $R^2$ |
|---|---|---|
| $CH_3(CH_2)_2CH_2$— | $CH_3CH_2$— | 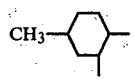 |
| $CH_3(CH_2)_4CH_2$— | $CH_3$— | 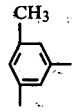 |

The half esters may be of a single dicarboxylic acid or a mixture of dicarboxylic acids. Further, the half ester may be of a single type (i.e. ester formation at the same carboxylic acid position on the ring) or the half ester may be a mixture of half esters formed at each of the two nonequivalent carboxylic acid positions on the ring.

The examples of the alkanol amine salts of the water insoluble half esters according to formula (I) usable in the practice of this invention there include, but not limited to, the following alkanol amine salts of each of the water insoluble half esters taught in Table I: (a) monoethanol amine salt, (b) diethanolamine salt, (c) triethanol amine salt, (d) diisopropanol amine salt, (e) monobutanol amine salt, (f) monoisopropanol amine salt (g) dibutanol amine salt, (h) triisopropanol amine salt, (i) N-methyl ethanol amine salt, (j) N,N-dimethyl ethanol amine salt, (k) N-isobutyl-4-hydroxybutyl amine salt, (l) N-ethyl ethanol amine salt, (m) N,N-dibutyl-3-hydroxypropyl amine salt, (n) N-methyl-bis-ethanol amine salt, (o) N-propyl-bis-4 hydroxybutyl amine salt, (p) hydroxyethyl ethylene diamine salt, (q) N-propyl-N-hydroxybutyl-1,6-hexamethylene diamine salt and (r) N,N,N',N'-tetrakis(2-hydroxyethyl)ethylene diamine salt.

As the surfactant usable in the practice of the corrosion inhibiting, aqueous functional fluid composition and the method of this invention there include the anionic, cationic, nonionic and amphoteric surface active agents. These surfactants are particularly organic compounds and often more particularly synthetic organic compounds. However, naturally occurring compounds which are surfactants are not excluded from the practice of this invention. Examples of anionic surfactants include but are not limited to alkali metal salts of petroleum sulfonic acids, alkali metal salts of alkyl aryl sulfonic acids (e.g. sodium dodecyl benzene sulfonate), alkali metal, ammonium and amine soaps of fatty acids (e.g. sodium stearate), sodium dialkyl sulfosuccinate, sulfated oils (e.g. sulfated castor oil) alkali metal alkyl sulfates and sulfonated oils (e.g. sulfonated tallow). Cationic surfactants include, for example, cetyl pyridinium bromide, hexadecyl morpholinium chloride, dilauryl triethylene tetramine diacetate, didodecylamine lactate, 1-amino-2-heptadecenyl imidazoline acetate, cetylamine acetate, tertiary ethoxylated soya amine cetyl trimethyl ammonium chloride and oleylamine acetate. As nonionic surfactants there include, for example, alkylene oxide adducts of fatty alcohols (e.g. ethylene oxide adduct of oleyl alcohol), alkylene oxide adducts of alkyl phenols (e.g. ethylene oxide adduct of nonyl phenol), alkylene oxide adducts of fatty acids (e.g. tetraethylene glycol monopalmitate, monoethylene glycol dioleate and hexaethylene glycol monostearate), partial higher fatty acid esters of polyhydric alcohols (e.g. glycerol monostearate, sorbitan tristearate, glycerol dioleate and pentaerythritol tripalmitate), alkylene oxide condensates of polyhydric alcohols (e.g. ethylene oxide condensates of glycerol, sorbitol, mannitol and pentaerythritol) and alkylene oxide condensates of polyhydric alcohol partial esters (e.g. ethylene oxide condensate of sorbitan monolaurate, glycerol monooleate and pentaerythritol monostearate).

Among amphoteric surfactants there are included, for example, alkyl-$\beta$-iminodipropionate, alkyl-$\beta$-aminopropionate, fatty imidazolines and betaines, more specifically 1-coco-5-hydroxyethyl-5-carboxymethyl imidazoline, dodecyl-$\beta$-alanine, N-dodecyl-N,N-dimethyl amino acetic acid and 2-trimethyl amino lauric acid inner salts.

The nonionic surfactants are especially useful in the practice of the corrosion inhibiting, aqueous functional fluid composition and method of this invention. There may, however, be used a mixture of surfactants of like or different types (e.g. mixture of nonionic surfactants and mixture of anionic and nonionic surfactants, mixture of cationic and nonionic surfactants and a compatible mixture of cationic and anionic surfactants). In some cases, surfactants are known to have lubricating properties and such surfactants can advantageously be employed in the practice of the corrosion inhibiting, aqueous functional fluid composition and method of this invention.

The concentration of the surfactant may vary widely in the practice of the corrosion inhibiting, aqueous functional fluid composition and method of this invention depending upon the nature of the surfactant and the other components of the functional fluid composition. Thus, the amount of the surfactant may vary depending upon whether it is a cationic or an anionic or a nonionic or an amphoteric surfactant as well as its particular structure and molecular composition. Usually, the surfactant can be employed in an amount of from 0.002% to 10%, preferably from 0.01% to 5%, based on the total weight of the corrosion inhibiting, aqueous functional fluid composition.

Water soluble or dispersible lubricants usable in the practice of the composition and method of this invention include synthetic and natural lubricants. As examples of natural lubricants there include petroleum oils, animal oils and fats, vegetable oils and fats and oils of marine origin. The petroleum oils may include paraffinic, naphthenic, asphaltic and mixed based oils. Among the synthetic lubricants there are, for example, included water soluble or dispersible hydrocarbon oils and halo-substituted hydrocarbon oils such as polymerized and interpolymerized olefins (e.g. polybutylenes, propyleneisobutylene copolymers, chlorinated polybutylenes, etc); alkyl benzenes (e.g. dodecylbenzene, tetradecylbenzene, dinonylbenzene, di-(2-ethylhexyl)benzene, etc.); polyphenyls (e.g., bi-phenyls, terphenyls, etc.); and the like. The alkylene oxide polymers and interpolymers and derivatives thereof where the terminal hydroxyl groups have been modified by esterification, etherification, etc., comprise examples of another class of known synthetic lubricating oils. These are exemplified by the oils prepared by polymerization of ethylene oxide propylene oxide, the alkyl and aryl ethers of these polyoxyalkylene polymers (e.g. methylpolyisopropylene glycol ether having an average molecular weight of 1000, diphenyl ether of polyethylene glycol having a molecular weight of 500 to 1000, diethyl ether of polypropylene glycol having a molecular weight of 1000 to 1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Other synthetic lubricants may include, for example, water soluble or dispersible esters of dicarboxylic acids (e.g. phthalic acid, succinic acid, maleic acid, azelaic acid, suberic acid, sebacic acid, fumaric acid, adipic acid, linoleic acid dimer, etc.) with a variety of alcohols (e.g., butyl alcohol, hexyl alcohol, dodecyl alcohol, 2-ethylhexyl alcohol, pentaerythritol, etc.). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicoxyl sebacate, the 2-ethylhexyl diester of linoleic acid dimer and the like.

Another useful class of synthetic lubricants include the silicone based oils such as, for example, water soluble or dispersible polyalkylpolyaryl-, polyalkoxy-, or polyaryloxy-siloxane oils and silicate oils (e.g., tetraethyl silicate, tetraisopropyl silicate, tetra(2-ethylhexyl)silicate, tetra-(p-tert-butylphenyl)silicate, hexyl-(4-methyl-2-pentoxy)disiloxane, poly(methyl)siloxanes, poly(methylphenyl)siloxanes, etc.). Other water soluble or dispersible synthetic lubricants include the liquid esters of phosphorus-containing acids (e.g. tri-cresyl phosphate, trioctyl phosphate, diethyl ester of decane phosphonic acid, etc.), polymeric tetrahydrofurans, and the like.

There may also be used as the synthetic lubricant water soluble or dispersible modified petroleum oils, such as, for example, the well known soluble oils obtained by the sulfonation of petroleum oil, modified animal oils and fats, such as the chlorinated and/or sulfonated animal oils and fats, and the modified vegetable oils and fats, such as, for example, the chlorinated and/or sulfonated vegetable oils and fats. Sulfurized natural oils that are water soluble or dispersible are also useful in this invention.

Various additives commonly known in the art, including, for example, extreme pressure agents, bacteriocides, fungicides, foam suppressants, settling agents, antioxidants and other corrosion inhibitors may be employed at conventional amounts, well known in the art, in the practice of the composition and method of this invention.

In the practice of the method according to this invention, the step of adjusting the pH of the corrosion inhibiting aqueous functional fluid to a value in the range of from 8 to 12 may, for example, be carried out by the use of water soluble organic amines, alkali metal hydroxides, alkali metal salts or buffering agents. The use of the water soluble or dispersible salt of the water insoluble half ester in accordance with this invention, as described herein, may, in some cases, be sufficient by itself to obtain a pH value for the fluid in the range of from 8 to 12. Where the step of adjusting the pH of the corrosion inhibiting aqueous functional fluid to achieve a value in the range of from 8 to 12 in accordance with the method of this invention is achieved by the use of the water soluble or dispersible alkali metal, ammonium or organic amine salt of the water insoluble half ester according to this invention and described herein, then the two steps of the method of this invention could be carried out simultaneously. The steps of the method of this invention, however, may be carried out separately (e.g. consecutively) such as, for example, where a water soluble organic amine may be employed by separate addition to adjust the pH of the corrosion inhibiting aqueous functional fluid to a value in the range of from 8 to 12. As a matter of convenience, for example, the same organic amine which forms the water soluble or dispersible organic amine salt of the water insoluble half ester in accordance with this invention and described herein may also be used in the method of this invention to adjust the pH of the corrosion inhibiting aqueous functional fluid to a value in the range from 8 to 12. Where for example the same organic amine would be used to form the water soluble or dispersible organic amine salt of the water insoluble half ester in accordance with this invention and description and to adjust the pH of the corrosion inhibiting aqueous functional fluid in accordance with the method of this invention that organic amine may be added separately in the pH adjusting step of the method of this invention or may be combined with the water soluble or dispersible organic amine salt of the water insoluble half ester as an excess over the organic amine needed to form the water soluble or dispersible organic amine salt of the water insoluble half ester.

The composition and method of this invention may be practiced in a number of well known ways. For example, in accordance with one procedure the water soluble or dispersible alkali metal, ammonium or organic amine salt of the water insoluble half ester and the surfactant may be added to water, the resulting combination mixed and then the pH of the fluid adjusted. In another procedure the water soluble or dispersible alkali metal, ammonium or organic amine salt of the water insoluble half ester may be formed by adding the water insoluble half ester to water containing the alkali metal, ammonium or organic amine ion, the surfactant and water soluble or dispersible organic lubricant added to the resulting aqueous system, the combination mixed and then the pH of the fluid adjusted to a value in the range of from 8 to 12. In a further procedure the water insoluble half ester could be added to water containing an excess of alkali metal compound, ammonia or organic amine over that amount of alkali metal compound, ammonia or organic amine needed to form the water soluble or dispersible alkali metal, ammonium or organic amine salt of the water insoluble half ester and sufficient to produce a pH value in the range of from 8 to 12 in the fluid, the water soluble or dispersible organic lubricant added to the resulting aqueous system and the combination mixed. In a still further procedure the surfactant and water soluble or dispersible organic lubricant could be added to the water, the amine salt of the water insoluble half ester added to the mixture, the combination mixed and then the pH of the fluid adjusted to a value in the range of from 8 to 12.

The water insoluble half esters disclosed herein may be prepared by methods well known in the art such as, for example, (1) by reacting 1 mole of the $C_4$ to $C_{10}$ aliphatic monohydric secondary alcohol with 1 mole of the dicarboxylic acid, (2) by reacting 1 mole of the $C_4$ to $C_{10}$ aliphatic monohydric secondary alcohol with 1 mole of the dicarboxylic anhydride and (3) by reacting 1 mole of the $C_4$ to $C_{10}$ aliphatic monohydric secondary alcohol with 1 mole of dicarboxylic acid halide and converting the unreacted acid halide group to a free acid group. Desirably a slight excess of the dicarboxylic acid, dicarboxylic anhydride or the dicarboxylic acid halide over the stoichiometric amount required to react with all of the monohydric secondary alcohol to form the half ester may be used to prepare the water insoluble half ester. The half ester formation reaction may be carried out at reduced or elevated temperatures, optionally in the presence of an inert solvent medium and/or inert atmosphere and optionally at sub or super atomspheric pressure. Conventional apparatus well known in the art may be used to prepare the water insoluble half ester.

Methods well known in the art may be used to prepare the water soluble or dispersible alkali metal, ammonium or organic amine salt of the water insoluble half ester in accordance with this invention, such as, for example, the water insoluble half ester can be added to an aqueous solution of the alkali metal, ammonia or organic amine or the alkali metal compound, ammonia or organic amine may be added to the water insoluble half ester in the presence of water. In an alternative method the water may be omitted.

The concentration of water, water soluble or dispersible alkali metal, ammonium or organic amine salt of the water insoluble half ester, as disclosed herein, surfactant and water soluble or dispersible lubricant in the corrosion inhibiting aqueous functional fluid composition of this invention may vary over a wide range. In some instances the concentration of water may be very low (e.g. less than 10% by weight based on total formulation). Such instances are what are commonly known in the art as concentrates. The use of concentrates helps to keep down costs by reducing the shipment of water which can be readily added to the concentrate in the desired amounts by the user of the aqueous functional fluid of this invention. On the other hand in some instances, particularly end use instances, the concentration of water can be very high (e.g. 99.8% by weight based on the total formulation). Thus, the concentration of water in the corrosion inhibiting aqueous functional fluid according to this invention may vary generally from about 15 to 99.8% by weight based on the total formulation. Preferably the amount of water is from 40% to 99.5% by weight based on the total formulation. The concentration of the surface active, corrosion inhibiting water soluble or dispersible alkali metal, ammonium or organic amine salt of the water insoluble half ester, as disclosed herein, may vary from about 0.002% to about 50%, preferably 0.02% to 10%, by weight based on the total formulation. Under some use conditions the surface active, corrosion inhibiting water soluble or dispersible salt of the water insoluble half ester, as disclosed herein, may be present in the corrosion inhibiting aqueous functional fluid composition of this invention in somewhat small amounts, such as, for example, from 0.006% to 0.5% by weight based on the total weight of the composition. There may be present in the corrosion inhibiting aqueous functional fluid composition of this invention an amount of water soluble or dispersible organic lubricant in the range of from 0.002% to about 10%, preferably 0.01% to 5%, by weight based on the total weight of the composition.

Among the preferred corrosion inhibiting aqueous functional fluid compositions of this invention, prior to any dilution, are those comprising from 40 to 99% by weight water, from 0.5 to 10% by weight of the surface active, corrosion inhibiting water soluble or dispersible alkanol amine salt of a water insoluble half ester according to formula (I) and from 0.5 to 5% by weight of the surfactant. Even more preferred corrosion inhibiting aqueous functional fluid compositions according to this invention are compositions, prior to any dilution, comprising from 40 to 99% by weight water, from 0.5 to 10% by weight of a surface active, corrosion inhibiting water soluble or dispersible organic amine salt of a water insoluble half ester according to formula (I) wherein $R^2$ is a cycloaliphatic, alkyl substituted cycloaliphatic, aromatic or alkyl substituted aromatic 1,2 divalent hydrocarbon radical having 6 to 7 carbon atoms and a $C_6$ carbocyclic ring, R is a $C_1$ to $C_7$ alkyl group and $R^1$ is a $C_1$ to $C_7$ alkyl group wherein $R+R^1$ has a total of from 4 to 8 carbon atoms and from 0.5 to 5% by weight of a surfactant. Still even more preferred corrosion inhibiting aqueous functional fluid compositions according to this invention are compositions comprising from 40 to 99% by weight of water, from 0.5 to 10% by weight of the surface active, corrosion inhibiting water soluble or dispersible mono, di or tri ($C_2$ to $C_4$ alkanol) amine salt of the water insoluble half ester according to formula (I) wherein $R^2$ is a cycloaliphatic or aromatic 1,2-divalent hydrocarbon radical having 6 carbon atoms and a $C_6$ carbocyclic ring, R is a $C_1$ to $C_7$ alkyl group and $R^1$ is a $C_1$ to $C_7$ alkyl group where $R+R^1$ has a total of from 4 to 8 carbon atoms and one of R or $R^1$ is a methyl group and from 0.5 to 5% by weight of a surfactant agent. Especially preferred corrosion inhibiting aqueous functional fluid compositions according to this invention are compositions, prior to any dilution, comprising from 40 to 75% by weight of water, from 0.5 to 6% by weight of the water soluble or dispersible, surface active corrosion inhibiting tri($C_2$–$C_4$ alkanol) amine salt of the water insoluble half ester according to formula (I) wherein $R^2$ is an unsaturated cycloaliphatic 1,2-divalent hydrocarbon radical having 6 carbon atoms and a $C_6$ carbocyclic ring, R is $C_1$ to $C_7$ alkyl group, $R^1$ is a $C_1$ to $C_7$ alkyl group, where $R+R^1$ has a total of from 6 to 8 carbon atoms and one of R or $R^1$ is a methyl group, and 0.5 to 5% by weight of a surfactant. In the above especially preferred practice of this invention there may be especially employed as the half ester according to formula (I) the 2-octanol half ester of 4-cyclohexene-1,2-dicarboxylic anhydride.

This invention is further described in the following non-limiting examples in which all amounts and percentages are by weight and all temperatures are in degrees centrigrade unless otherwise specified.

EXAMPLES 1 to 21

Water insoluble half esters in accordance with formula (I) are shown in these examples as given in Table II below.

TABLE II

| Example | Structure | Molecular Weight |
|---|---|---|
| 1 | 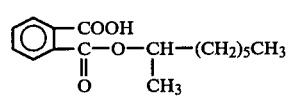 | 278.4 |
| 2 | 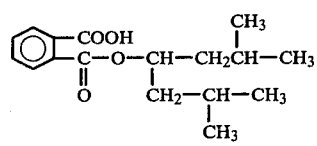 | 292.4 |
| 3 | 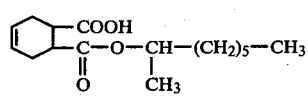 | 282.4 |

TABLE II-continued

| Example | Structure | Molecular Weight |
|---|---|---|
| 4 | 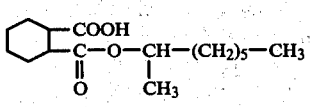 | 284.4 |
| 5 | 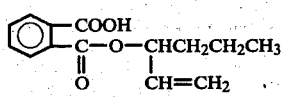 | 248.3 |
| 6 | 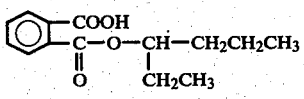 | 250.3 |
| 7 | 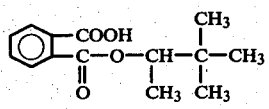 | 250.3 |
| 8 | 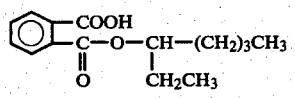 | 264.3 |
| 9 | 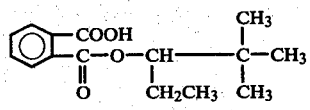 | 264.3 |
| 10 | 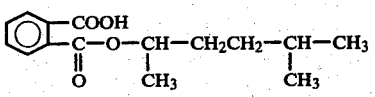 | 264.3 |
| 11 | 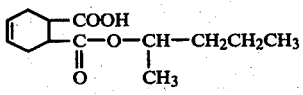 | 240.3 |
| 12 | 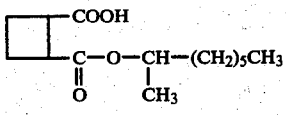 | 256.3 |
| 13 | 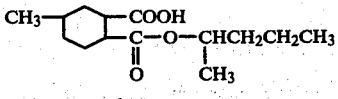 | 256.3 |
| 14 | 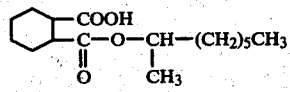 | 284.4 |
| 15 | 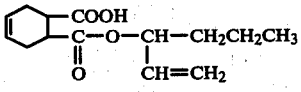 | 252.3 |
| 16 | 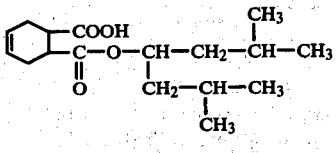 | 296.4 |

TABLE II-continued

| Example | Structure | Molecular Weight |
|---|---|---|
| 17 | 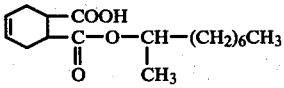 | 296.4 |
| 18 | 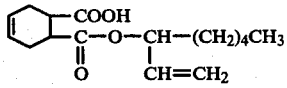 | 280.4 |
| 19 | 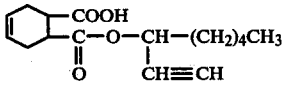 | 278.4 |
| 20 | 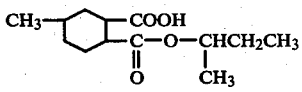 | 242.3 |
| 21 | 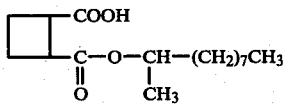 | 284.4 |

EXAMPLES 22 to 42

In these examples there are shown the surface active (i.e. coupling) behavior of the salts of the water insoluble half esters according to formula (I).

| Material | Formulations A (% by wt.) | B (% by wt.) | C (% by wt.) |
|---|---|---|---|
| Water | 72.0 | 70.0 | 68.0 |
| Ethanolamine borate | 23.0 | 23.0 | 23.0 |
| Surfonic® N-10* | 0.5 | 0.5 | 0.5 |
| Lubricant** | 2.5 | 2.5 | 2.5 |
| Monoethanol amine salt (see Table III below) | 2.0 | 4.0 | 6.0 |

Each of the above A, B and C formulations were prepared with each of the monoethanol amine salts indicated in Table III below and tested for stability by keeping separate portions of each of the formulations at 40° F., room temperature and 130° F. for 48 hours and periodically observing the solutions for separation of the components. Table III below shows the lowest concentration of the salt, of the three concentrations tested, at which a stable system was obtained upon 48 hours of exposure to the above temperatures.

TABLE III

| Example | Monoethanolamine salt of the half ester of Example*** | Minimum concentration of the salt (% by wt.) |
|---|---|---|
| 22 | 1 | 4 |
| 23 | 2 | 6 |
| 24 | 3 | 2 |
| 25 | 4 | 2 |
| 26 | 5 | 6 |
| 27 | 6 | 6 |
| 28 | 7 | 6 |
| 29 | 8 | 4 |
| 30 | 9 | 4 |
| 31 | 10 | 4 |
| 32 | 11 | 4 |
| 33 | 12 | 2 |

TABLE III-continued

| Example | Monoethanolamine salt of the half ester of Example*** | Minimum concentration of the salt (% by wt.) |
|---|---|---|
| 34 | 13 | 2 |
| 35 | 14 | 4 |
| 36 | 15 | 4 |
| 37 | 16 | 6 |
| 38 | 17 | 4 |
| 39 | 18 | 4 |
| 40 | 19 | 4 |
| 41 | 20 | 4 |
| 42 | 21 | 2 |

*ethylene oxide adduct of nonyl phenol; nonionic surfactant produced by the Texaco Chemical Company. Surfonic is a registered trademark of the Texaco Chemical Company
**polyethylene glycol polyester of dimer acid
***see Table II for the identity of the half ester

EXAMPLES 43 to 50

The monoethanol amine salts of the half esters shown in these examples were tested in accordance with the formulations A, B and C and the procedure described in Examples 22 to 42. All of the monoethanol amine salts of the half esters of these examples did not produce stable formulations in accordance with the test procedure and at one or more of the conditions of Examples 22 to 42. The half esters (see Table IV below) of these examples are similar to but not in complete accordance with formula (I) for the reasons given in Table IV below. These examples serve as comparative examples for showing the poor or non-existent surface active behavior for salts of half esters which, although similar to, are not in accordance with formula (I) half esters.

TABLE IV

| Example No. | Structure | Molecular Weight | Distinction from Formula (I) half ester |
|---|---|---|---|
| 43 | 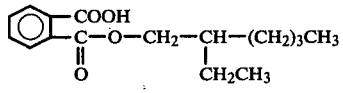 | 278.4 | Primary alcohol half ester |
| 44 | 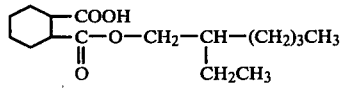 | 284.4 | Primary alcohol half ester |
| 45 | 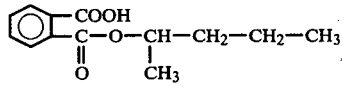 | 236.3 | Molecular weight below 240 |
| 46 | 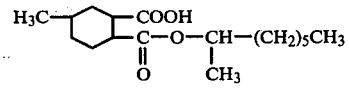 | 298.4 | Molecular weight over 297 |
| 47 | 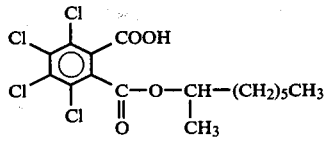 | 416.1 | Molecular weight over 297 |
| 48 | 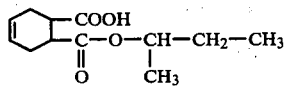 | 226.3 | Molecular weight below 240 |
| 49 | 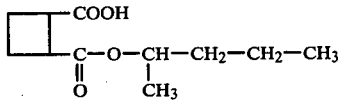 | 214.3 | Molecular weight below 240 |
| 50 | $CH_3-(CH_2)_5-\underset{}{\overset{CH_3}{\overset{\vert}{CH}}}-O-\overset{O}{\overset{\Vert}{C}}-(CH_2)_4COOH$ | 253.8 | Aliphatic dicarboxlic acid half ester |

EXAMPLE 51

| Material | % by wt. |
|---|---|
| **Formulation** | |
| **Part A** | |
| Sodium petroleum sulfonate | 3.0 |
| Oleic diethanolamide | 8.0 |
| 200 SUS oil* | 10.0 |
| **Part B** | |
| Triethanolamine | 2.5 |
| Triethanolamine salt of the half ester of Example 13 | 2.4 |
| Water | 74.1 |

*complex mixture of petroleum naphthenic based hydrocarbons having a viscosity of 200 SUS units at 100° F.

21.0 Parts of Part A and 79.0 parts of Part B, each heated to 140° F., were blended together by adding Part A to Part B with agitation. The resulting clear formulation was stable at 40° F., room temperature and 130° F. for 48 hours when tested in accordance with the procedure described in Examples 22 to 42. However, the comparable formulation omitting the triethanolamine salt of the half ester of Example 13 separated at room temperature within 48 hours.

EXAMPLE 52

| Formulation | |
|---|---|
| Material | % by wt. |
| Water | 85.6 |
| Monoethanolamine | 5.0 |
| Triethanolamine | 5.0 |
| Glycerol monooleate | 0.5 |
| Monoethanolamine salt of the half ester of Example 13 | 3.9 |

The formulation of this example was found to be stable at 48 hours at 40° F., room temperature and 130° F. when tested in accordance with the procedure described in Examples 22 to 42. However, the above formulation without the monoethanolamine salt of the half ester of Example 13 separated readily at room temperature.

EXAMPLES 53 to 55

| | % by wt. | | |
|---|---|---|---|
| Material/Property | Example 53 | Example 54 | Example 55 |
| Water | 92.0 | 91.8 | 90.0 |
| Lubricant* | 2.5 | 2.5 | 2.5 |
| Surfonic® N-10** | 0.5 | 0.5 | 0.5 |
| Monoethanolamine salt of the half ester of Example 13 | 5.0 | 5.0 | 5.0 |
| Monoethanolamine | — | 0.2 | 2.0 |
| pH | 7.5 | 8.0 | 10.0 |
| 48 hr. stability at 40° F. | — | stable | stable |
| 48 hr. stability at room temp. | separates | stable | stable |
| 48 hr. stability at 130°0 F. | — | stable | stable |

*See Examples 22 to 42
**See Examples 22 to 42

The stability tests of these examples were conducted in accordance with the procedure described in Examples 22 to 42.

EXAMPLES 56 and 57

| | % by wt. | |
|---|---|---|
| Material | Example 56 | Example 57 |
| Water | 70.6 | 75.6 |
| Lubricant* | 0.1 | 10.0 |
| Surfonic® N-10** | 10.0 | 0.1 |
| Monoethanolamine | 5.0 | 5.0 |
| Triethanolamine | 5.0 | 5.0 |
| Monoethanolamine salt of the half ester of Example 13 | 9.3 | 4.3 |

*See Examples 22 to 42
**See Example 22 to 42

The formulations of these two examples were found to be stable at 40° F., room temperature and 130° F. when tested in accordance with the procedure described in Examples 22 to 42. However, the same formulations without the monoethanolamine salt of the half ester of Example 13 separated within 48 hours.

EXAMPLES 58 to 77

| Formulation | |
|---|---|
| Material | % by wt. |
| Water | 93-x |
| Lubricant* | 2.5 |
| Surfonic® N-10** | 0.5 |
| Half ester of Example 13 | 4.0 |
| Cation forming compound (see Table V below) | x |

TABLE V

| Example | | | | Stability at 48 hours at | | |
|---|---|---|---|---|---|---|
| No. | Cation forming Compound | x | pH | 40° F. | Room Temp. | 130° F. |
| 58 | NaOH | 0.37 | 12 | stable | stable | stable |
| 59 | KOH | 0.42 | 12 | stable | stable | stable |
| 60 | Monoethanolamine | 2.95 | 10 | stable | stable | stable |
| 61 | Triethanolamine | 22.62 | 9 | stable | stable | stable |
| 62 | Monoisopropanol amine | 3.90 | 10 | stable | stable | stable |
| 63 | Diethanolamine | 14.83 | 10 | stable | stable | stable |
| 64 | 2-ethyl hexyl amine*** | 3.71 | 10 | | separ. | |
| 65 | Jeffamine® D-400① | 17.59 | 10 | stable | stable | stable |
| 66 | Jeffamine® D-2000②*** | 16.23 | 9 | | separ. | |
| 67 | Jeffamine® T-403③ | 11.61 | 10 | stable | stable | stable |
| 68 | Jeffamine® ED-900④ | 9.68 | 9 | stable | stable | stable |
| 69 | Jeffamine® D-230⑤ | 7.00 | 10 | stable | stable | stable |
| 70 | Jeffamine® M-600⑥ | 12.27 | 9 | stable | stable | stable |
| 71 | Ethylene diamine | 1.69 | 10 | stable | stable | stable |
| 72 | Diglycolamine | 6.21 | 10 | stable | stable | stable |
| 73 | Methoxyethoxy propyl amine | 3.47 | 10 | stable | stable | stable |
| 74 | Morpholine | 4.13 | 9 | stable | stable | stable |
| 75 | Dimethylaminoethanol | 7.00 | 10 | stable | stable | stable |
| 76 | $NH_4OH$ (28% ammonia) | 5.79 | 10 | stable | stable | stable |

TABLE V-continued

| Example No. | Cation forming Compound | x | pH | Stability at 48 hours at 40° F. | Room Temp. | 130° F. |
|---|---|---|---|---|---|---|
| 77 | Dimethylaminopropylamine | 2.27 | 10 | stable | stable | stable |

①polyoxypropylene diamine (total amine = 4.99 meq/gm; primary amine = 4.93 meq/gm) average molecular weight approximately = 400 - Texaco Chemical Co.
②polyoxypropylene diamine (total amine - 0.96 meq/gm; primary amine - 0.95 meq/gm) average molecular weight approx. = 2000 - Texaco Chemical Co.
③primary amine terminated (triamine) propylene oxide adduct of 2,2-di-hydroxymethyl butanol having a total of about 5.3 oxypropylene units. Texaco Chemical Co.
④$H_2NCH(CH_3)CH_2(OCH(CH_3)CH_2)_a(OCH_2CH_2)_b(OCH_2CH(CH_3))_cNH_2$ wherein a + c is approx. 3.5 and b is approx. 20.5 - Texaco Chemical Co.
⑤polyoxpropylene diamine (total amine = 8.45 meq/gm; Primary amine = 8.30 meq/gm) average molecular weight approximately = 230 - Texaco Chemical Co.
⑥$CH_3OC_2H_4O(CH_2\overset{CH_3}{\overset{|}{C}}HO)_8CH_2\overset{CH_3}{\overset{|}{C}}HNH_2$;
total amine = >1.66 meq/gm, primary amine = >1.71 meq/gm - Texaco Chemical Company
Jeffamine is a registered trademark of the Texaco Chemical Company
*See Examples 22 to 42
**See Example 22 to 42
***The salt of the half ester of Example 13 is water insoluble The use of various cation forming compounds and thus various salts of a half ester according to formula (I) have been shown in these examples.

EXAMPLES 78 AND 79

| Material/Property | % by wt./performance Example 78 | Example 79 |
|---|---|---|
| Water | 90.4 | 91.1 |
| Lubricant* | 2.5 | 2.5 |
| Surfonic ® N-10** | 0.5 | 0.5 |
| Monoethanolamine salt of the half ester of Example 1 | 4.0 | — |
| Monoethanolamine salt of the half ester of Example 3 | — | 4.0 |
| pH | 10 | 10 |
| 48 hours at 40° F. | stable | stable |
| 48 hours at room temperature | stable | stable |
| 48 hours at 130° F. | stable | stable |

*See Examples 22 to 42
**See Examples 22 to 42

The stability tests were conducted in accordance with the procedure described in Examples 22 to 42.

EXAMPLES 80 TO 101

These examples demonstrate corrosion inhibiting activity for salts of a number of water insoluble half esters according to formula (I). A formulation of 99.5% by weight of water and 0.5% by weight of triethanolamine (Example 80) was used for comparison. Examples 81 to 101 are given by the following formulation.

| Formulation Material | % by wt. |
|---|---|
| Water | 99.0 |
| Triethanolamine | 0.5 |
| Half ester according to formula (I) (See Table below) | 0.5 |

The above formulation and the formulation of Example 80 were employed in the following test procedure and the results obtained are shown in Table VI below.

The metal (i.e. cast iron and steel) test specimens were prepared and tested in the following manner. The flat surface of the cast iron rod test piece was ground and lapped to obtain a uniform surface which was free of scratches, etchings, cross grains or other artifacts. The flat surface of the cast iron test piece was wiped clean with lens paper and then blown clean with air. Immediately after cleaning, the cast iron test piece was placed in a humidity box (100% relative humidity) and a small amount of the test fluid uniformly distributed over the ground and lapped flat surface of the cast iron test piece. The humidity box was then closed and sealed. The cast iron test piece was allowed to remain in the closed and sealed humidity box overnight and then removed for examination.

In the corrosion tests on steel plugs, the flat surface of the steel test pieces were prepared in the same manner as the surfaces of the cast iron test pieces (see above). A small amount of the test fluid was then uniformly distributed over the prepared surface of the steel test pieces after they had been placed in the humidity box. The humidity box was then closed and sealed and the steel test pieces kept in the box overnight. The steel test pieces were cleaned, allowed to dry and then examined.

TABLE VI

| Example No. | Half Ester of Example No. | Corrosion Results Cast Iron | Steel |
|---|---|---|---|
| 80 | — | rust | rust |
| 81 | 1 | no rust | no rust |
| 82 | 2 | no rust | no rust |
| 83 | 3 | no rust | no rust |
| 84 | 4 | no rust | no rust |
| 85 | 5 | no rust | no rust |
| 86 | 6 | no rust | no rust |
| 87 | 7 | no rust | no rust |
| 88 | 8 | no rust | no rust |
| 89 | 9 | no rust | no rust |
| 90 | 10 | no rust | no rust |
| 91 | 11 | no rust | no rust |
| 92 | 12 | no rust | no rust |
| 93 | 13 | no rust | no rust |
| 94 | 14 | no rust | no rust |
| 95 | 15 | no rust | no rust |
| 96 | 16 | no rust | no rust |
| 97 | 17 | no rust | no rust |
| 98 | 18 | no rust | no rust |
| 99 | 19 | no rust | no rust |
| 100 | 20 | no rust | no rust |
| 101 | 21 | no rust | no rust |

EXAMPLES 102 TO 108

In these examples the formulation below was diluted at 5 parts by weight of formulation to 95 parts by weight of water and tested in accordance with the procedure described in Examples 80 to 101. The results obtained are shown in Table VII below.

| Formulation | |
|---|---|
| Material | % by weight |
| Water | 94-x |
| Triethanolamine | 5.0 |
| Surfonic® N-95* | 1.0 |
| Monoethanolamine salt (See Table VII below) | x |

*polyoxyethylene adduct of nonyl phenol - nonionic surface active agent produced by the Texaco Chemical Company. Surfonic is a registered trademark of the Texaco Chemical Company.

TABLE VII

| Example No. | Monoethanolamine salt of the half ester of Example No. | x | pH of diluted fluid | Corrosion Result Cast Iron | Steel |
|---|---|---|---|---|---|
| 102 | — | — | 9.9 | rust | rust |
| 103 | 3 | 2.0 | 9.9 | no rust | no rust |
| 104 | 3 | 4.0 | 9.9 | no rust | no rust |
| 105 | 3 | 6.0 | 9.9 | no rust | no rust |
| 106 | 13 | 2.0 | 9.9 | no rust | no rust |
| 107 | 13 | 4.0 | 9.9 | no rust | no rust |
| 108 | 13 | 6.0 | 9.9 | no rust | no rust |

EXAMPLES 109 TO 114

Corrosion inhibiting tests on aluminum and copper in these examples were conducted in accordance with the following procedure using the formulation given below and the results obtained are shown in Table VIII.

Procedure

Freshly polished strips of aluminum and copper were separately immersed for 24 hours in each of the test fluids, whereupon the aluminum and copper strips were removed from the fluids and examined. The test fluid employed was 5% by weight of the formulation described below and 95% by weight of water.

| Formulation | |
|---|---|
| Material | % by wt. |
| Water | 74-x |
| Ethanolamine borate | 23.0 |
| Lubricant* | 2.5 |
| Surfonic® N-10** | 0.5 |
| Monoethanolamine salt (See Table VIII below | x |

*See Examples 22–42
**See Examples 22–42

TABLE VIII

| Example No. | Monoethanolamine Salt of the Half Ester of Example No. | x | pH of Diluted Fluid | Corrosion Result Aluminum | Copper |
|---|---|---|---|---|---|
| 109 | 3 | 2.0 | 9.3 | sl. stain | no stain |
| 110 | 3 | 4.0 | 9.3 | sl. stain | no stain |
| 111 | 3 | 6.0 | 9.3 | sl. stain | no stain |
| 112 | 13 | 2.0 | 9.3 | sl. stain | no stain |
| 113 | 13 | 4.0 | 9.3 | sl. stain | no stain |
| 114 | 13 | 6.0 | 9.3 | sl. stain | no stain |

EXAMPLES 115–120

Corrosion tests on aluminum and copper were conducted in accordance with the procedure described in Examples 109 to 114 using as the test fluid 5% by weight of the formulation given below and 95% by weight of water and the results obtained are shown in Table IX.

| Formulation | |
|---|---|
| Material | % by wt. |
| Water | 99.9-x |
| Triethanolamine | 0.1 |
| Triethanolamine salt (See Table IX below) | x |

TABLE IX

| Example No. | Triethanolamine Salt of the Half Ester of Example No. | x | pH of Diluted Fluid | Corrosion Result Aluminum | Copper |
|---|---|---|---|---|---|
| 115 | — | — | 9.5 | severe stain | no stain |
| 116 | 1 | 0.15 | 8.3 | light stain | no stain |
| 117 | 3 | 0.15 | 8.2 | sl. stain | no stain |
| 118 | 4 | 0.15 | 8.3 | sl. stain | no stain |
| 119 | 13 | 0.15 | 8.2 | light stain | no stain |
| 120 | 21 | 0.15 | 8.2 | sl. stain | no stain |

EXAMPLES 121–123

In these examples V-tool lubricity tests were conducted in accordance with the following procedure, using the formulations A and B described below diluted at the ratio of 5% by weight of the formulation and 95% by weight of water. The results obtained are shown in Tables X and XI respectively, below.

Procedure

A wedge-shaped high-speed steel tool is forced against the end of a rotating (88 surface feet per minute) SAE 1020 steel tube of ¼ inch wall thickness. The feed force of the tool is sufficient to cut a V-groove in the tubing wall, and the chips flow out of the cutting area in two pieces (one piece from each face of the wedge-shaped tool). The forces on the tool as a result of workpiece rotation and of tool feed are measured by a tool post dynamometer connected to a Sanborn recorder. Any welding of chips to tool build-up is reflected in the interruption of chip-flow (visual) and in increased force and resistance to workpiece rotation. The cutting test is performed with the tool-chip interface flooded throughout the operation with circulating test fluid. Tool and workpiece are in constant dynamic contact during this time and the test is not begun until full contact is achieved all along each cutting edge. The duration of the test is three minutes.

| Formulation A | |
|---|---|
| Material | % by wt. |
| Water | 74-x |
| Ethanolamine borate | 23.0 |
| Lubricant* | 2.5 |
| Surfonic® N-10** | 0.5 |
| Monoethanolamine salt | x |

TABLE X

| Example No. | Monoethanolamine Salt of the Half Ester of Example No. | x | Force (lbs) |
|---|---|---|---|
| 121 | 3 | 2 | 497 |
| 122 | 13 | 2 | 497 |

| Formulation B | |
|---|---|
| Material | % by wt. |
| Water | 80 |
| Half ester of Example No. 3 | 10 |
| Triethanolamine | 10 |

TABLE XI

| Example No. | Formulation | Force (lbs) |
|---|---|---|
| 123 | B | 464 |

EXAMPLES 124 TO 127

| | Example No. (% by wt./Performance) | | | |
|---|---|---|---|---|
| Material/Property | 124 | 125 | 126 | 127 |
| Water | 87.9 | 78.0 | 87.9 | 87.0 |
| Monoethanolamine | 5 | 5 | 5 | 5 |
| Triethanolamine | 5 | 5 | 5 | 5 |
| MA 300* | 0.1 | 10.0 | — | — |
| Cetyltrimethylammonium chloride | | | 0.1 | 1.0 |
| Monoethanolamine salt of the half ester of Example 3 | 2 | 2 | 2 | 2 |
| Stability @ 48 hours | | | | |
| 40° F. | stable | stable | stable | stable |
| Room Temp. | stable | stable | stable | stable |
| 130° F. | stable | stable | stable | stable |

*MA 300 is a 40% active aqueous solution of a surfactant compound having the following formula and obtained from the Texaco Chemical Company $$R-O-CH_2-\underset{\underset{CH_3}{|}}{CH}-O-CH_2-\underset{\underset{CH_3}{|}}{CH}-\underset{\underset{H}{|}}{N}-CH_2-CH_2-COOH$$

where R is a mixture of 10 and 12 carbon atom alkyl groups

The stability tests in these examples were conducted according to the procedure described in Examples 22 to 42.

I claim:

1. A corrosion inhibiting aqueous functional fluid composition comprising (a) water, (b) a water soluble or dispersible, surface active, corrosion inhibiting alkali metal, ammonium or organic amine salt of a water insoluble $C_4$ to $C_{10}$ aliphatic monohydric secondary alcohol half ester of a hydrocarbon carbocyclic dicarboxylic acid or anhydride having 6 to 9 carbon atoms and a $C_4$ to $C_6$ carbocyclic ring and selected from the group consisting of cycloaliphatic, alkyl substituted cycloaliphatic, aromatic or alkyl substituted aromatic dicarboxylic acid or anhydride, said half ester having a molecular weight in the range of from 240 to 297 and optionally (c) a substance selected from the group consisting of a surfactant and a water soluble or dispersible lubricant or mixtures thereof, said fluid having a pH in the range of from 8 to 12.

2. A corrosion inhibiting aqueous functional fluid composition according to claim 1 comprising (a), (b) and (c).

3. A corrosion inhibiting aqueous functional fluid composition according to claim 2 wherein (c) is a surfactant.

4. A corrosion inhibiting aqueous functional fluid composition according to claim 2 wherein (c) is a water soluble or dispersible lubricant.

5. A corrosion inhibiting aqueous functional fluid composition according to claim 2 wherein (c) is a mixture of a surfactant and a water soluble or dispersible lubricant.

6. A corrosion inhibiting aqueous functional fluid composition according to claim 1 comprising (a) and (b).

7. A corrosion inhibiting aqueous functional fluid composition according to claims 3, 4, 5 or 6 wherein (b) is the water soluble or dispersible alkali metal, ammonium or organic amine salt of a water insoluble half ester having the formula $$R-\underset{\underset{R^1}{|}}{CH}-O-\overset{\overset{O}{\|}}{C}-R^2-\overset{\overset{O}{\|}}{C}-OH$$

where

R and $R^1$ are the same or different and are selected from the group consisting of straight or branched chain alkyl group having 1 to 8 carbon atoms or straight or branched chain alkenyl or alkynyl group having 2 to 8 carbon atoms such that the sum of the carbon atom content of R and $R^1$ is from 3 to 9 and $R^2$ is a divalent hydrocarbon carbocyclic group having from 4 to 7 carbon atoms and a $C_4$ to $C_6$ carbocyclic ring selected from the group consisting of divalent cycloaliphatic, alkyl substituted cycloaliphatic, aromatic or alkyl substituted aromatic radicals, said half ester having a molecular weight in the range of from 240 to 297.

8. A corrosion inhibiting aqueous functional fluid composition according to claim 7 wherein $R^2$ is a divalent cycloaliphatic radical.

9. A corrosion inhibiting aqueous functional fluid composition according to claim 7 wherein $R^2$ is a divalent alkyl substituted cycloaliphatic radical.

10. A corrosion inhibiting aqueous functional fluid composition according to claim 7 wherein $R^2$ is a divalent aromatic radical.

11. A corrosion inhibiting aqueous functional fluid composition according to claim 8 wherein the salt is a mono, di or tri ($C_2$ to $C_4$ alkanol) amine salt.

12. A corrosion inhibiting aqueous functional fluid composition according to claim 9 wherein the salt is a mono, di or tri ($C_2$ to $C_4$ alkanol) amine salt.

13. A corrosion inhibiting aqueous functional fluid composition according to claim 10 wherein the salt is a mono, di or tri ($C_2$ to $C_4$ alkanol) amine salt.

14. A corrosion inhibiting aqueous functional fluid composition according to claim 11 wherein the water insoluble half ester is the 2-octanol half ester of 4-cyclohexene-1,2-dicarboxylic anhydride.

15. A method of preparing a corrosion inhibiting aqueous functional fluid composition comprising the steps of (1) mixing together (a) water (b) a water soluble or dispersible, surface active, corrosion inhibiting alkali metal, ammonium or organic amine salt of a water insoluble $C_4$ to $C_{10}$ aliphatic monohydric secondary alcohol half ester of a hydrocarbon carbocyclic dicarboxylic acid or anhydride having 6 to 9 carbon atoms and a $C_4$ to $C_6$ carbocyclic ring and selected from the group of cycloaliphatic, alkyl substituted cycloaliphatic, aromatic or alkyl substituted aromatic dicarboxylic acid or anhydride, said half ester having a molecular weight in the range of from 240 to 297 and optionally (c) a substance selected from the group consisting of a surfactant and a water soluble or dispersible organic lubricant or mixtures thereof and (2) adjusting the pH of the fluid to within the range of from 8 to 12.

16. The method according to claim 15 wherein step 1 is the step of mixing (a) and (b).

17. The method according to claim 15 wherein step 1 is the step of mixing (a), (b) and (c).

18. The method according to claims 16 or 17 wherein steps 1 and 2 are conducted simultaneously.

19. The method according to claims 16 or 17 wherein the half ester has the following formula:

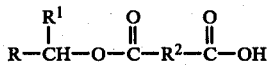

where

R and $R^1$ are the same or different and are selected from the group consisting of straight or branched chain alkyl group having 1 to 8 carbon atoms or straight or branched chain alkenyl or alkynyl group having 2 to 8 carbon atoms such that the sum of the carbon atom content of R and $R^1$ is from 3 to 9 and $R^2$ is a divalent hydrocarbon carbocyclic group having 4 to 7 carbon atoms and a $C_4$ to $C_6$ carbocyclic ring selected from the group consisting of divalent cycloaliphatic, alkyl substituted cycloaliphatic, aromatic or alkyl substituted aromatic radicals, said half ester having a molecular weight in the range of from 240 to 297.

20. The method according to claim 19 wherein $R^2$ is a divalent cycloaliphatic radical and the salt is an alkanol amine salt.

21. The method according to claim 19 wherein $R^2$ is a divalent alkyl substituted cycloaliphatic radical and the salt is an alkanol amine salt.

22. The method according to claim 19 wherein $R^2$ is a divalent aromatic radical and the salt is an alkanol amine salt.

23. The method of working metal comprising the step of working metal in the presence of a corrosion inhibiting aqueous functional fluid composition according to claim 7.

* * * * *